US010196759B2

(12) United States Patent
Schmitz et al.

(10) Patent No.: US 10,196,759 B2
(45) Date of Patent: Feb. 5, 2019

(54) MULTI-COMPONENT FIBERS PRODUCED BY A ROTATIONAL SPINNING METHOD

(75) Inventors: Wiebke Schmitz, Munich (DE); Dirk Grafahrend, Mannheim (DE); Denis Reibel, Herrlisheim (FR)

(73) Assignee: CARL FREUDENBERG KG, Weinheim (DE)

( * ) Notice: Subject to any disclaimer, the term of this patent is extended or adjusted under 35 U.S.C. 154(b) by 605 days.

(21) Appl. No.: 13/636,767

(22) PCT Filed: Jan. 18, 2011

(86) PCT No.: PCT/EP2011/000177

§ 371 (c)(1),
(2), (4) Date: Sep. 24, 2012

(87) PCT Pub. No.: WO2011/116848

PCT Pub. Date: Sep. 29, 2011

(65) Prior Publication Data

US 2013/0011676 A1 Jan. 10, 2013

(30) Foreign Application Priority Data

Mar. 25, 2010 (DE) ..... 10 2010 012 845

(51) Int. Cl.

| | |
|---|---|
| ***D01D 5/30*** | (2006.01) |
| ***D01D 5/18*** | (2006.01) |
| ***D01F 1/10*** | (2006.01) |

(52) U.S. Cl.

CPC ..... *D01D 5/18* (2013.01); *D01D 5/30* (2013.01); *D01F 1/103* (2013.01); *Y10T 428/2929* (2015.01)

(58) Field of Classification Search

CPC combination set(s) only.
See application file for complete search history.

(56) References Cited

U.S. PATENT DOCUMENTS

| | | | | |
|---|---|---|---|---|
| 2,998,620 | A | 9/1961 | Stalego | |
| 3,075,241 | A * | 1/1963 | Dietzsch et al. | 425/463 |
| 3,333,932 | A * | 8/1967 | Tiede | 65/502 |
| 3,358,322 | A * | 12/1967 | Woodbery | 425/8 |
| 5,474,590 | A | 12/1995 | Lin | |
| 5,702,658 | A * | 12/1997 | Pellegrin et al. | 264/172.14 |

(Continued)

FOREIGN PATENT DOCUMENTS

| | | |
|---|---|---|
| DE | 1127538 B | 4/1962 |
| DE | 69500256 T2 | 10/1997 |

(Continued)

OTHER PUBLICATIONS

Simmonds. WO 2009/009632 A2. Method and Apparatus for Making Submicron Diameter Fibers and Webs There From. Jan. 15, 2009.*

(Continued)

*Primary Examiner* — Marla D McConnell
*Assistant Examiner* — Kevin Worrell
(74) *Attorney, Agent, or Firm* — Leydig, Voit & Mayer, Ltd.

(57) ABSTRACT

A multi-component fiber includes a first component made of a first fiber raw material and a second component made of a second fiber raw material. The first and second components are combined by rotational spinning so as to form a fiber body.

9 Claims, 4 Drawing Sheets

(56) References Cited

U.S. PATENT DOCUMENTS

| | | | | |
|---|---|---|---|---|
| 7,173,104 | B2 | 2/2007 | Raetzsch et al. | |
| 2005/0136253 | A1* | 6/2005 | Michael et al. | 428/364 |
| 2007/0232169 | A1* | 10/2007 | Strickler et al. | 442/181 |
| 2010/0285291 | A1 | 11/2010 | Reibel et al. | |
| 2011/0129510 | A1 | 6/2011 | Liebmann et al. | |

FOREIGN PATENT DOCUMENTS

| | | | |
|---|---|---|---|
| EP | 0801039 | A1 | 10/1997 |
| EP | 0801040 | A2 | 10/1997 |
| EP | 1627941 | A1 | 2/2006 |
| EP | 2042199 | A2 | 4/2009 |
| JP | 44000902 | A | 1/1969 |
| JP | 2008170216 | A | 7/2008 |
| RU | 2321602 | C2 | 4/2008 |
| WO | WO 03046053 | A1 | 6/2003 |
| WO | WO 2009009632 | A2 | 1/2009 |
| WO | WO 2009036958 | A2 | 3/2009 |
| WO | WO 2009058990 | A2 | 5/2009 |
| WO | WO 2010015709 | A2 | 2/2010 |

OTHER PUBLICATIONS

European Patent Office, International Search Report in International Patent Application No. PCT/EP2011/000177 (dated Sep. 9, 2011).
Japanese Patent Office, Japanese Office Action, dated Feb. 7, 2014.

* cited by examiner

MULTI-COMPONENT FIBERS PRODUCED BY A ROTATIONAL SPINNING METHOD

CROSS-REFERENCE TO PRIOR APPLICATIONS

This application is a U.S. National Phase application under 35 U.S.C. § 371 of International Application No. PCT/EP2011/000177, filed on Jan. 18, 2011 and claims benefit to German Patent Application No. DE 10 2010 012 845.7, filed on Mar. 25, 2010. The International Application was published in German on Sep. 29, 2011 as WO 2011/116848 under PCT Article 21(2).

FIELD

The invention relates to a multi-component fiber, comprising a first component and a second component which together form a fiber body, the first component being made of a first fiber raw material and the second component being made of a second fiber raw material. The invention also relates to a method in which a first fiber raw material is filled into a first container while a second fiber raw material is filled into a second container, whereby both containers are rotated, the first fiber raw material being discharged from the first container and the second fiber raw material being discharged from the second container, and whereby the fiber raw materials are combined after leaving the containers.

BACKGROUND

From the state of the art, it is a known procedure to manufacture and produce hollow fibers, bi-component fibers or multi-component fibers from the melt by means of classic spinning methods.

Before this backdrop, European application EP 801 039 A2 discloses a method for the production of bi-component fibers using rotating containers. In this method, a first molten mineral fiber raw material is discharged from a first rotating container through nozzles. A second molten, mineral fiber raw material is applied from the outside onto the discharged first mineral fiber raw material in that the second molten, mineral fiber raw material is centrifuged onto the outer wall of the first rotating container. The first container is arranged at a distance from the second container, and the containers can be rotated independently of each other.

In the prior-art methods, it is a drawback that multi-component fibers can only be made by using high temperatures, namely, by creating melts. Here, it is especially disadvantageous that heat-sensitive fiber raw materials cannot be processed into bi-component fibers without being damaged. Particularly medicinal drugs, fungicides, bactericides and similar heat-sensitive materials cannot be processed with the above-mentioned methods.

SUMMARY

In an embodiment, the present invention provides a multi-component fiber. A first component is made of a first fiber raw material and a second component is made of a second fiber raw material. The first and second components are combined by rotational spinning so as to form a fiber body.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
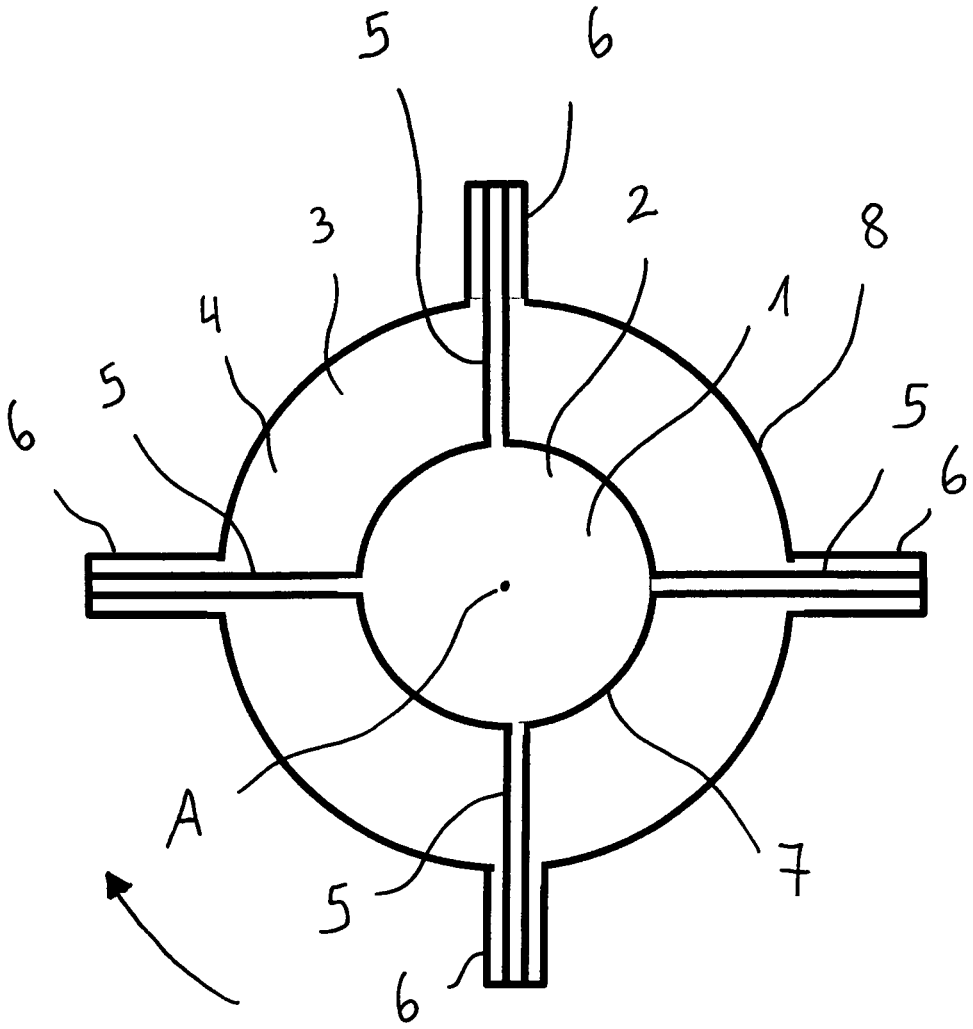
FIG. 1 is a sectional top view of a device with an internal rotor and an external rotor.

In an embodiment, the invention provides a multi-component fiber in which heat-sensitive fiber raw materials can be processed without being damaged.

Accordingly, in an embodiment, the multi-component fiber is produced by means of a rotational spinning method. Such a method provides that the containers are rotated around the same axis, the first fiber raw material being discharged from the first container through a first channel nozzle and the second fiber raw material being discharged from the second container through a second channel nozzle.

Multi-component fibers that are produced by the method described here are often twisted together. Here, at least two multi-component fibers are wound around each other like two strands. This effect occurs especially in rotational spinning methods. In this manner, it can be recognized whether multi-component fibers were produced by means of a rotational spinning method.

According to an embodiment of the invention, it has been recognized that multi-component fibers can be made from temperature-sensitive fiber raw materials by means of a rotational spinning method. These fiber raw materials are precisely the ones that cannot be used in classic spinning methods that employ melts without being damaged. In concrete terms, it has been recognized that even fiber raw materials that cannot be processed by thermoplastic processes can be spun from a spinning solution. Finally, it has been recognized that, with the method according to an embodiment of the invention, biodegradable substances and biopolymers, which usually cannot melt or which are very temperature-sensitive, can be spun into multi-component fibers or non-wovens. This is achieved according to an embodiment of the invention in that two containers are rotated around the same axis. This means that the fiber raw materials discharged by centripetal forces can be combined to form multi-component fibers without any problems. By suitably selecting the rotational speed, the retention time of the fiber raw materials in the containers can be selected in such a way that they are only exposed to heat for a very short period of time, as a result of which they are not damaged due to the temperatures. Consequently, a multi-component fiber can be made in which heat-sensitive fiber raw materials can be processed without being damaged.

In this manner, the above-mentioned objective is achieved.

The multi-component fiber could have a bio-compatible component and/or could display biodegradability in the bodies of humans or animals. The multi-component fiber could be biodegradable in the bodies of humans or animals. As a result, the multi-component fiber can be placed onto a wound and can grow together with the human or animal body tissue without any problem or it can be degraded by the body.

At least one component of the multi-component fiber could contain a medicinal drug or be made of a medicinal drug. In this manner, drugs can be administered in fiber form to a human or animal. It is conceivable to make wound dressings of non-wovens into whose fibers medicinal drugs have been incorporated. Other areas of application are in the realms of cosmetics, tissue engineering and implants.

At least one component could contain a substance whose structure is destroyed after being heated for at least two minutes at a temperature of at least 50° C. [122° F.]. In this context, the term "destruction of the structure" also means a reduction of the specific action of the substance. Such a substance can be configured as a drug, especially an antibiotic, an enzyme, a growth factor or an analgesic agent.

At least one component could contain an antibiotic. Antibiotics suppress the growth of bacteria or germs.

At least one component could contain an enzyme. Enzymes can regulate metabolic processes.

At least one component could contain a growth factor. Growth factors can influence cell growth.

At least one component could contain an analgesic agent. In this manner, the multi-component fibers can be placed onto wounds and can alleviate wound pain.

In order to avoid repetitions, reference is hereby made to the elaborations above pertaining to the multi-component fiber as such.

The fiber raw materials could be combined in such a way that they complement each other to form a multi-component fiber. In this context, the fiber raw materials, which are still soft, can be adhesively bonded to each other after exiting from their appertaining channel nozzles. The channel nozzles are brought together in such a way that multi-component fibers having different structures are formed. Thus, bi-component fibers, especially so-called core-shell fibers or side-by-side fibers, can be produced.

The first container could be fitted with an internal rotor while the second container could be fitted with an external rotor, said second container peripherally surrounding said first container, and whereby a channel nozzle of the first container runs concentrically inside a channel nozzle of the second container. Such a method allows the production of a multi-component fiber that is configured especially as a so-called core-shell fiber.

The first container could be fitted with a lower rotor part while the second container is fitted with an upper rotor part, and whereby a channel nozzle of the first container having a semi-circular cross section is placed onto a channel nozzle of the second container having a semi-circular cross section. Such a method can produce a multi-component fiber that is configured as a so-called side-by-side fiber.

A device for carrying out the method described here comprises two containers that can be rotated around the same axis, a first container being fitted with first channel nozzles, and a second container being fitted with second channel nozzles, and whereby the first channel nozzles and the second channel nozzles are flush with each other. In this manner, multi-component fibers can be produced since, after the exiting fiber raw materials leave the channel nozzles, they can form a cohesive solid, adhesive bond with each other.

The method described here could produce core-shell fibers with a filling of active ingredient, so-called drug-release fibers. The shell could consist of a hydrogel material, especially of gelatin, PVA, etc. Thus, an active ingredient can diffuse out of the core-shell fiber. A core-shell fiber could contain a core that promotes wound healing or that is antibacterial such as, for example, Medihoney, panthenol, chitosan and the like. For absorbent wound dressings, it would also be possible to produce core-shell fibers with a non-gelling core and with a gelling shell. It is also conceivable to produce side-by-side fibers using gelling and non-gelling material.

In order to produce hollow fibers, the core of a core-shell fiber could be provided that can be washed out or removed. The core could be removed, for example, by means of a heat treatment. The hollow fiber acquires a larger surface area when the core is removed. The surface activity of a fibrous wound dressing is increased by increasing the accessible surface area of the fiber.

The method described here could also be used to produce the core of a core-shell fiber by spinning fiber raw materials that are very difficult or impossible to spin. In particular, it would be conceivable to spin aqueous solutions together with active ingredients or proteins.

With the method described here, it would also be possible to spin two fiber raw materials together that react with each other. Here, it is concretely conceivable to spin a polymer with its cross-linking agent. In this manner, the spinning process and a cross-linking reaction can be carried out in one step.

In the method described here, spinning solutions, dispersions, emulsions or melts of the following polymers as well as mixture of these polymers could be used:

Synthetic biodegradable polymers such as polylactides, polylactide-co-glycolide copolymers, e.g. Resomer RG 502 H, polylactide-block-polyethylene oxides, e.g. Resomer RGP d 5055, polycaprolactones, polycaprolactone-block-polyethylene oxides, polyanhydrides, e.g. polifeprosan, polyorthoester, polyphosphoester, e.g. polylactophates, synthetic biocompatible polymers or polymers that are used in medicine such as polyethylene glycols, polyethylene oxides, polyvinyl pyrrolidone, polyvinyl alcohols, polyethylenes, polypropylenes, polyurethanes, polydimethyl siloxanes, polymethyl methacrylates, polyvinyl chlorides, polyethylene terephthalates, polytetrafluoroethylenes, poly-2-hydroxyethyl methacrylates, biopolymers such as proteins and peptides, polysaccharides, lipids, nucleic acids and special gelatins, collagens, alginates, celluloses, elastins, starches, chitins, chitosans, hyaluronic acid, dextrans, shellac, polymer-active ingredient conjugates, namely, an active ingredient or additive bonded to a biodegradable or biocompatible polymer, and copolymers of the above-mentioned polymer classes.

Additives or active ingredients could be added to the spinning solutions:

Here, it is possible to use enzymes, antimicrobial agents, vitamins, antioxidants, anti-infectives, antibiotics, antiviral active ingredients "anti-rejection agents", analgesics, analgesic combinations, antiphlogistics, anti-inflammatories, agents that promote wound healing, hormones, steroids, testosterone, estradiol, peptides and/or peptide sequences, immobilized adhesion-promoting peptide sequences, such as peptide sequences and peptide fragments of extracellular matrix proteins, especially peptides containing one or more of the amino acid sequences RGD, LDV, GFOGER, IKVAV, SVVYGLR, COMP, ADAM, POEM, YIGSR, GVKGDK-GNPGWPGAP, cyclo-DfKRG, KRSR, isolated and/or genetically produced proteins, polysaccharides, glycoproteins, lipoproteins, amino acids, growth factors, especially from the growth factor families TGF, especially TGF-ß), FGF, PDGF, EGF, GMCSF, VEGF, IGF, HGF, IL-1B, IL8 and NG, RNA siRNA, mRNA and/or DNA, anticancer agents such as paclitaxel, doxorubicin, 1,3-bis-2-chloroethyl-1-nitrosourea BCNU, camphothecin, living cells, opiates, nicotine, nitroglycerin, clonidine, fentanyl, scopolamine, rapamycin, sirolimus, gentamicin sulfate, gentamicin crobefate, amino sulfonic acids, sulfonamide peptides, peptide-analog molecules on the basis of D-amino acids, furanone derivatives, dexamethasone, ß-tricalcium phosphate and/or hydroxyapatite, particularly special hydroxyapatite nanoparticles, in concentrations of 0.000001%-70%.

The method described here opens up a wide spectrum of spinnable fiber raw materials such as biopolymers, especially proteins, polysaccharides and polymers in aqueous spinning solutions or in organic solvents.

It is also conceivable for the method to be carried out with fiber raw materials melts such as, for instance, melts of polymers, especially polycaprolactone, and polysaccharides, especially saccharose.

Different spinning solutions could also be mixed. In particular, a first spinning solution, namely, a solution of polyvinyl pyrrolidone and polyvinyl alcohol, could be mixed together with a second spinning solution, namely, a solution of gelatin and sodium alginate.

Likewise conceivable is the use of dispersions and emulsions as spinning solutions.

The method described here can also be used to spin fiber raw materials that are generally impossible to spin as the core of a fiber. In particular, an aqueous solution could be spun with a dissolved active ingredient.

The multi-component fibers created with the method described here could undergo after-treatments such as cross-linking reactions. The multi-component fibers could also be processed into a non-woven by needle-punching methods.

The fiber raw materials mentioned in the description could be configured as spinning solutions.

There are various possibilities to configure and refine the teaching of the present invention in an advantageous manner. For this purpose, reference is made, on the one hand, to the subordinate claims, and, on the other hand, to the explanation below of preferred embodiments of the method according to the invention and to the multi-component fibers according to embodiments of the invention.

Generally preferred embodiments and refinements of the teaching are explained in conjunction with the explanation of the preferred embodiments.

FIG. 1 shows a device for carrying out a method in which a first fiber raw material 1 is filled into a first container 2 while a second fiber raw material 3 is filled into a second container 4, whereby both containers 2, 4 are rotated, the first fiber raw material 1 being discharged from the first container 2 and the second fiber raw material 3 being discharged from the second container 4, and whereby the fiber raw materials 1, 3 are combined after leaving the containers 2, 4.

The containers 2, 4 are rotated around the same axis A, the first fiber raw material 1 being discharged from the first container 1 through a first channel nozzle 5 and the second fiber raw material 3 being discharged from the second container 4 through a second channel nozzle 6. The fiber raw materials 1, 3 are combined in such a way that they complement each other to form a multi-component fiber.

The first container 2 is fitted with an internal rotor 7 while the second container 4 is fitted with an external rotor 8, the second container 4 peripherally surrounding the first container 2, and whereby a channel nozzle 5 of the first container 2 runs concentrically inside a channel nozzle 6 of the second container 4. The internal rotor 7 and the external rotor 8 are arranged concentrically. The channel nozzles 5, 6 have outlet openings from which the fiber raw materials 1, 3 exit.

Figure 2:
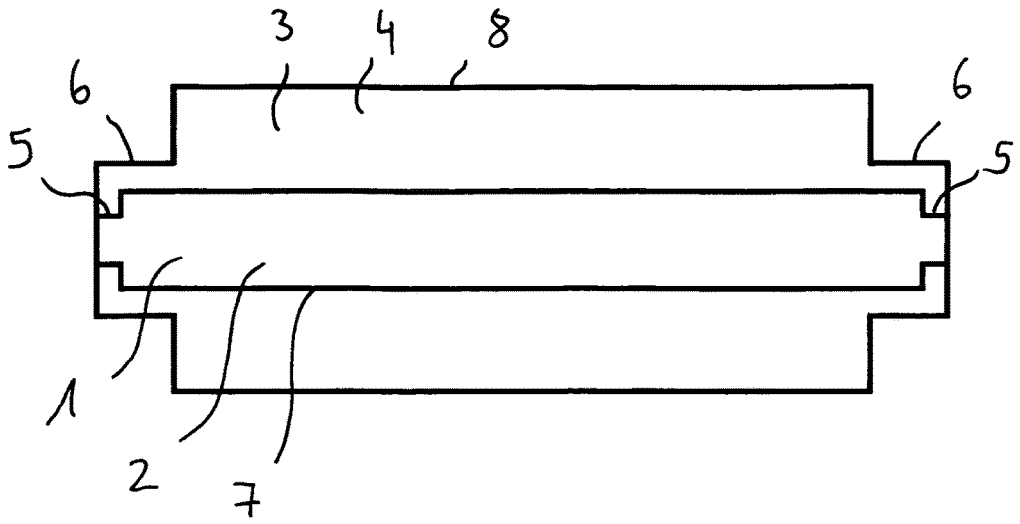
FIG. 2 is a side sectional view of a device with an internal rotor and an external rotor.

FIG. 2 shows a side sectional view of a device for carrying out the method described above, the first container 2 being completely accommodated in the second container 4 and concentrically surrounded by it.

Figure 3:
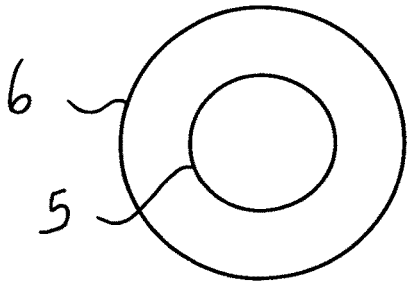
FIG. 3 is a top view of the outlet side of the channel nozzles of the devices according to FIGS. 1 and 2.

FIG. 3 shows a top view of the outlet openings of the concentrically arranged channel nozzles 5, 6 of FIGS. 1 and 2 by means of which a core-shell fiber can be produced.

Figure 4:
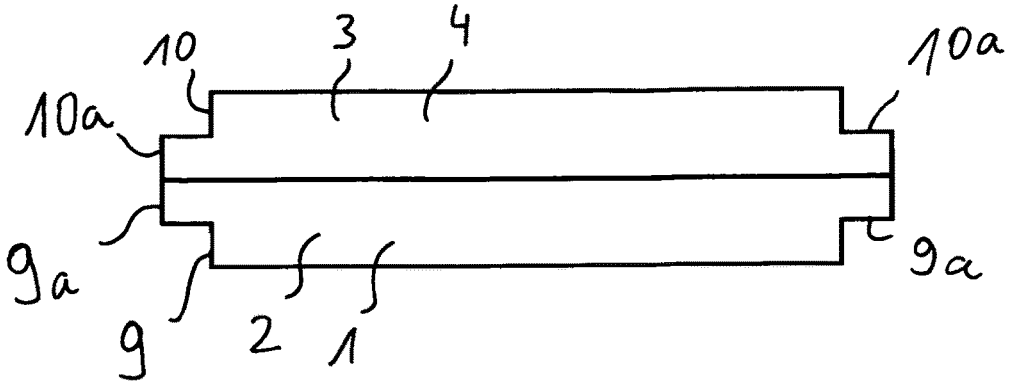
FIG. 4 is a side sectional view of a device with an upper rotor part and a lower rotor part.

FIG. 4 shows a side sectional view of a device for carrying out the method described here in which the first container 2 is fitted with a lower rotor part 9 while the second container 4 is fitted with an upper rotor part 10, and whereby a channel nozzle 9*a* of the first container 2 having a semi-circular cross section is placed onto a channel nozzle 10*a* of the second container 4 having a semi-circular cross section.

The channel nozzles 9*a*, 10*a* have outlet openings from which the fiber raw materials 1, 3 exit.

Figure 5:
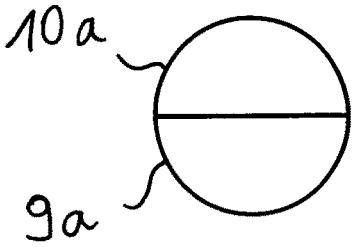
FIG. 5 is a top view of the outlet side of the channel nozzles of the device according to FIG. 4.

FIG. 5 shows a top view of the outlet openings of the channel nozzles 9*a*, 10*a* that have semi-circular cross sections and that have been placed next to each other along their flat sides. This channel nozzle profile is used to produce a side-by-side fiber.

Figure 6:
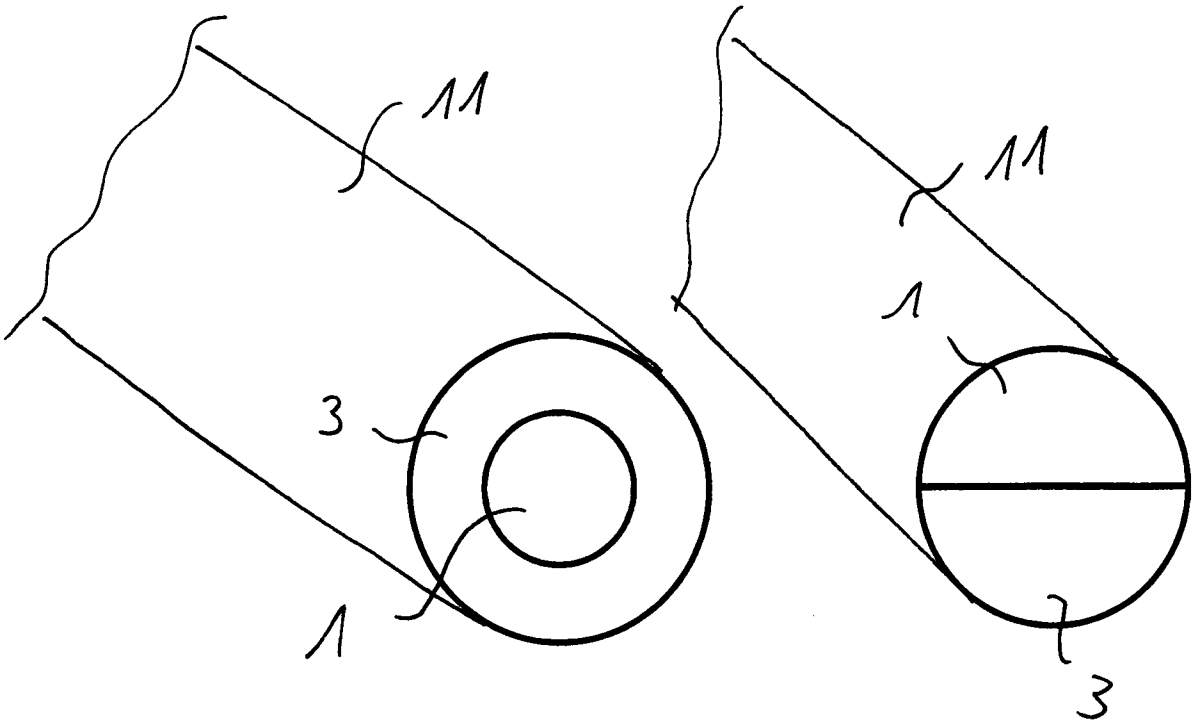
FIG. 6 is a core-shell fiber and a side-by-side fiber.

In FIG. 6, the left-hand view shows a multi-component fiber that is configured as a core-shell fiber, and the right-hand view shows a multi-component fiber that is configured as a side-by-side fiber.

FIG. 6 shows two multi-component fibers, each comprising a first component and a second component, which together form a fiber body 11, the first component being made of a first fiber raw material 1 and the second component being made of a second fiber raw material 3. The multi-component fibers have been produced by means of a rotational spinning method.

The embodiments below explain how multi-component fibers or non-wovens are produced with the devices described above.

Here, the above-mentioned fiber raw materials 1, 3 are configured as spinning solutions.

Example 1

Production of Bi-Component Fibers that are Configured as Core-Shell Fibers

A non-woven consisting of core-shell fibers is produced by means of a device according to FIG. 1 by a rotational spinning method as follows:

A 20% gelatin solution is prepared as spinning solution 1. A gelatin of type A PIGSKIN made by the GELITA AG company is used. The gelatin is stirred into water. Then the gelatin solution is left to rest for about one hour in order to swell. Subsequently, the gelatin solution is dissolved and then kept at a temperature of 60° C. [140° F.] for about two hours.

An aqueous 40% polyvinyl pyrrolidone solution is prepared as spinning solution 3. The polyvinyl pyrrolidone (molecular weight of approximately 40,000 g/mol) is stirred into water and dissolved in a water bath at 70° C. [158° F.].

Spinning solution 1 is fed via a hose pump into the container 2 of the internal rotor 7 and, at the same time, spinning solution 3 is fed via another hose pump into the container 4 of the external rotor 8.

The containers 2, 4 have a temperature of about 80° C. [176° F.] and rotate at a speed of 4500 rpm around the shared axis A. The internal rotor 7 is located inside the external rotor 8. Channel nozzles 5 that have a diameter of 0.5 mm extend from the internal rotor 7. They each open up into the channel nozzles 6 of the external rotor 8 that have a diameter of 1.0 mm and, together with it, they form a spinning nozzle for the production of bi-component fibers with core-shell segmenting or else for the production of hollow fibers.

Owing to the centripetal force, the fiber raw material 1, 3 is pressed through the channel nozzles 5, 6 and spun into bi-component fibers that are drawn by a suction device. The suction device is situated underneath the containers 2, 4.

The fact that the polymers have not suffered degradation in this process can be substantiated by means of chromatography.

Example 2

Production of Bi-Component Fibers that, as Core-Shell Fibers, are Configured with an Unspinnable Core A non-woven consisting of bi-component fibers with core-shell segmenting is produced by means of a device according to FIG. 1 by a rotational spinning method as follows:

A 5% gelatin solution is used as spinning solution 1. A gelatin of type A PIGSKIN made by the GELITA AG company is used. The gelatin is stirred into water. Then the gelatin solution is left to rest for about one hour in order to swell. Subsequently, the gelatin solution is dissolved and then kept at a temperature of 60° C. [140° F.] for about two hours.

As spinning solution 3, an aqueous active ingredient solution of acetylsalicylic acid at a concentration of 0.1 mg/L and 1% by weight of polyethylene oxide (molecular weight of approximately 900,000 g/mol) is used. The acetylsalicylic acid is dissolved in water.

Spinning solution 1 is fed via a hose pump into the container 2 of the internal rotor 7, and spinning solution 3 is fed via another hose pump into the container 4 of the external rotor 8.

The containers 2, 4 have a temperature of about 60° C. [140° F.] and rotate at a speed of 4500 rpm.

The internal rotor 7 is located inside the external rotor 8. Channel nozzles 5 that have a diameter of 0.5 mm extend from the internal rotor 7. They each open up into the channel nozzles 6 of the external rotor 8 that have a diameter of 1.0 mm and, together with it, they form a spinning nozzle for the production of bi-component fibers with core-shell segmenting or else for the production of hollow fibers.

Through the centripetal force, the fiber raw material 1, 3 is pressed through the channel nozzles 5, 6 and spun into bi-component fibers that are drawn by a suction device. The suction device is situated underneath the containers 2, 4.

Example 3

Production of Bi-Component Fibers that are Configured as Side-By-Side Fibers, with Side-By-Side Segmenting A non-woven consisting of bi-component fibers with side-by-side segmenting is produced by means of a device according to FIG. 4 by a rotational spinning method as follows:

In order to prepare spinning solution 3, an aqueous 40% polyvinyl pyrrolidone solution is prepared. The polyvinyl pyrrolidone (molecular weight of approximately 40,000 g/mol) is stirred into water and dissolved in a water bath at 70° C. [158° F.].

In order to prepare spinning solution 1, a 40% gelatin solution is prepared. A gelatin of type A PIGSKIN made by the GELITA AG company is used. The gelatin is stirred into water. Then the gelatin solution is left to rest for about one hour in order to swell. Subsequently, the gelatin solution is dissolved and then kept at a temperature of 60° C. [140° F.] for about two hours.

Spinning solution 3 is fed via a hose pump into the container 4 of the upper rotor part 10, and spinning solution 1 is fed via another hose pump into the container 2 of the lower rotor part 9.

The containers 2, 4 have a temperature of about 80° C. [176° F.] and rotate at a speed of 4500 rpm.

The rotor 9, 10 is divided into an upper container 4 and a lower container 2. The channel nozzles 9*a*, 10*a* of the lower container 2 and of the upper container 4 have diameters of 0.3 mm and are flush with the outer wall of the rotor 9, 10, and together, they form a spinning nozzle for the production of bi-component fibers with side-by-side segmenting. This is shown in FIGS. 4 and 5.

Owing to the centripetal force, the fiber raw material 1, 3 is pressed through the channel nozzles 9*a*, 10*a* and spun into bi-component fibers that are drawn by a suction device. The suction device is situated underneath the containers 2, 4.

The viscosities of the spinning solutions 1, 3 are set in such a way that, after they leave the channel nozzles 5, 6, 9*a*, 10*a*, they are sufficiently firm to form a fiber body. After the spinning solutions 1, 3 leave the channel nozzles 5, 6, 9*a*, 10*a*, they can cool off and become tightly bonded and/or cross-linked.

Regarding additional advantageous embodiments and refinements of the teaching according to the invention, reference is made, on the one hand, to the general part of the description and, on the other hand, to the accompanying claims.

The terms used in the attached claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B." Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise.

The invention claimed is:

1. A method comprising:

filling a first container with a first fiber raw material and filling a second container with a second fiber raw material, the second container concentrically surrounding the first container relative to an axis, at least one of the fiber raw materials including a substance whose structure would be destroyed upon being heated for two minutes at a temperature of 50° C. and at least one of the fiber raw materials containing a medicinal drug;

rotating each of the containers around the axis; and discharging the first fiber raw material from the first container solely by centripetal force through a first channel projecting radially outward from the first container and passing through the second container and discharging the second fiber raw material from the second container solely by centripetal force through a second channel concentrically surrounding the first channel so that the first and second fiber raw materials together form a core-shell fiber.

2. The method according to claim 1, wherein the first container is fitted with an internal rotor and the second container is fitted with an external rotor, and wherein the first channel nozzle runs concentrically inside the second channel nozzle.

3. A method for forming a multi-component fiber, the method comprising:

filling a first container with a first fiber raw material and filling a second container with a second fiber raw material, the second container concentrically surrounding the first container relative to an axis;

rotating each of the containers around the axis; and discharging the first fiber raw material from the first container solely by centripetal force through a first channel projecting radially outward from the first container and discharging the second fiber raw material from the second container solely by centripetal force through a second channel projecting radially outward from the second container so that the first and second raw fiber materials together form the multi-component fiber.

4. The method according to claim 3, wherein at least one of the fiber raw materials including a substance whose structure would be destroyed upon being heated for two minutes at a temperature of 50° C.

5. The method according to claim 4, wherein the at least one of the fiber raw materials is a medicinal drug.

6. The method according to claim 3, wherein the second channel concentrically surrounds the first channel such that the multi-component fiber is a core-shell fiber.

7. The method according to claim 3, further comprising adjusting the rotation speed of the containers so as to change a retention time of the fiber raw materials.

8. The method according to claim 1, further comprising adjusting the rotation speed of the containers so as to change a retention time of the fiber raw materials.

9. The method according to claim 1, wherein the medicinal drug is contained in the first fiber raw material and the second fiber raw material consists of a hydrogel material such that the medicinal drug is diffusible from a core of the core-shell fiber.

* * * * *